US012571533B2

(12) United States Patent
Etter et al.

(10) Patent No.: US 12,571,533 B2
(45) Date of Patent: Mar. 10, 2026

(54) EMISSION REDUCTION SYSTEM

(71) Applicant: Etter Engineering Company, Inc., Bristol, CT (US)

(72) Inventors: Thomas M. Etter, Middlefield, CT (US); Jon G. Moore, Sr., Hamden, CT (US)

(73) Assignee: ETTER ENGINEERING COMPANY, INC., Bristol, CT (US)

( * ) Notice: Subject to any disclaimer, the term of this patent is extended or adjusted under 35 U.S.C. 154(b) by 0 days.

(21) Appl. No.: 18/935,023

(22) Filed: Nov. 1, 2024

(65) Prior Publication Data

US 2025/0297734 A1 Sep. 25, 2025

Related U.S. Application Data

(60) Provisional application No. 63/568,993, filed on Mar. 22, 2024.

(51) Int. Cl.

| | |
|---|---|
| ***B01D 53/86*** | (2006.01) |
| ***F23G 7/06*** | (2006.01) |
| ***F23G 7/07*** | (2006.01) |

(52) U.S. Cl.
CPC ..... *F23G 7/07* (2013.01); *F23G 7/068* (2013.01)

(58) Field of Classification Search
CPC ..... B01D 53/86; F23G 7/068; F23G 7/07
See application file for complete search history.

(56) References Cited

U.S. PATENT DOCUMENTS

| | | | | |
|---|---|---|---|---|
| 4,774,065 | A * | 9/1988 | Penzhorn | G21B 1/115 376/325 |
| 5,131,224 | A | 7/1992 | Siewert et al. | |
| 5,599,510 | A * | 2/1997 | Kaminsky | B01J 23/14 585/602 |
| 6,999,883 | B1 | 2/2006 | Brady et al. | |
| 7,364,712 | B2 | 4/2008 | Ohtsuka et al. | |
| 7,448,828 | B2 | 11/2008 | Augenstein et al. | |
| 7,520,743 | B1 | 4/2009 | Roberts | |
| 9,067,175 | B2 | 6/2015 | Ohtsuka et al. | |

(Continued)

FOREIGN PATENT DOCUMENTS

| | | |
|---|---|---|
| CA | 2325966 A1 | 5/2002 |
| CA | 2325966 | 5/2008 |

(Continued)

OTHER PUBLICATIONS

Mallett et al; Progress in Developing Ventilation Air Methane Mitigation and Utilisation Technologies, CSIRO Exploration and Mining, Technology Court, Pullenvale, QLD 4069, Australia Jun. 16, 2024; 18 pages; http://www.coalinfo.net.cn/coalbed/meeting/2203/papers/coal-mining/CM003.pdf.

(Continued)

*Primary Examiner* — Randy Boyer
(74) *Attorney, Agent, or Firm* — Womble Bond Dickinson (US) LLP

(57) ABSTRACT

A system for emission reduction may include a housing defining a housing interior, a gas inlet configured to receive gas, a first emission reduction module comprising a first catalytic heater, and internal tubing disposed in the housing interior and configured to transport and control the gas to the first catalytic heater of the first emission reduction module.

19 Claims, 15 Drawing Sheets

(56) References Cited

U.S. PATENT DOCUMENTS

| | | | |
|---|---|---|---|
| 9,676,695 | B2 | 6/2017 | Nunley et al. |
| 2004/0192546 | A1 | 9/2004 | Dang et al. |
| 2009/0282976 | A1 | 11/2009 | Ruskin |
| 2011/0250115 | A1 | 10/2011 | Chen et al. |
| 2017/0120191 | A1 | 5/2017 | Nurkowski et al. |

FOREIGN PATENT DOCUMENTS

| | | | |
|---|---|---|---|
| CN | 101915117 | A | 12/2010 |
| CN | 102213106 | | 10/2011 |
| CN | 102218286 | A | 10/2011 |
| CN | 101915117 | | 2/2012 |
| CN | 101737077 | | 4/2012 |
| CN | 202700477 | | 1/2013 |
| CN | 202700477 | U | 1/2013 |
| CN | 102218286 | | 4/2013 |
| CN | 102205207 | | 6/2013 |
| CN | 102230393 | | 6/2013 |
| CN | 105080337 | | 11/2015 |
| CN | 106540538 | | 3/2017 |

OTHER PUBLICATIONS

Peter Hinde, COMET—A New Ventilation Air Methane (VAM) Abatement Technology, Johnson Matthey Techn. Rev., 2016, 18 pages; http://www.technology.matthey.com/article/60/3/211-221/.

Canadian Intellectual Property Office; Notice of Allowance issued for Canadian Patent Application No. 3031277; issued Jan. 22, 2024; 1 page.

United States Patent and Trademark Office; Non-Final Office Action issued for U.S. Appl. No. 16/253,301; issued Jul. 25, 2019; 15 pages.

United States Patent and Trademark Office; Notice of Allowance issued for U.S. Appl. No. 16/253,301; issued Dec. 31, 2019; 16 pages.

Hinde, Peter; Mitchell, Ian and Riddell, Martin; COMET™—A New Ventilation Air Methane (VAM) Abatement Technology, Johnson Matthey Technology Review, Jan. 1, 2016; pp. 211-221.

Mallett, C.W., Su, S.; "Progress in Developing Ventilation Air Methane Mitigation and Utilisation Technologies", CSIRO Exploration and Mining; 18 pages, Jun. 16, 2004.

* cited by examiner

EMISSION REDUCTION SYSTEM

The application claims priority to U.S. Provisional Application No. 63/568,993 filed Mar. 22, 2024, the entire contents of which are incorporated herein by reference.

BACKGROUND

Political, scientific and sociological debate over the past twenty years has converged on the topic of global warming and the effects of production and venting of so-called greenhouse gases, or gases that trap heat in the atmosphere. The effects of greenhouse gases can be seen in the melting of the polar ice caps, rising sea levels, increases in the global average yearly temperature, extremes in weather (such has really hot or cold temperatures), allergies, and the effects on certain plant and animal species.

Some gases are more effective than others in making the planet warmer. Of the three most abundant greenhouse gases in the Earth's atmosphere, namely, water vapor, carbon dioxide, and methane, each of these gases can remain in the atmosphere for different amounts of time, ranging from a few years to thousands of years. While all of these most abundant greenhouse gases remain in the atmosphere long enough to become uniformly mixed and distributed in the atmosphere, the emitting of methane into the atmosphere is of primary concern. In one example of an attempt to combat this, in 2012, the Environmental Protection Agency ("EPA") set a goal of reducing methane emissions by 40-45% from 2012 levels by 2025. Additionally, in 2024, the United States Environmental Protection Agency and Department of Energy announced various incentives for reducing methane pollution and greenhouse gases.

Methane is emitted during the production and transport of coal, natural gas, and oil. Methane emissions also result from livestock and other agricultural practices and by the decay of organic waste in municipal solid waste landfills. Methane is the primary component of natural gas, and is the principal greenhouse gas emitted by equipment and processes in the oil and gas sector; and, through leakage and venting during the process of drilling for oil and gas can have a serious effect on the atmosphere. While methane doesn't remain in the atmosphere as long as carbon dioxide does, it has far more devastating consequences to the climate because of how effectively it absorbs heat. In the first two decades after its release, methane became 84 times more detrimental than carbon dioxide.

More recently, the EPA has updated the New Source Performance Standards (or "NSPS") for the oil and gas industry to add requirements that the industry reduce emissions of greenhouse gases and to cover additional equipment and activities in the oil and gas production chain. The final rule will accomplish this by setting emissions limits for methane, which is the principal greenhouse gas emitted by equipment and processes in the oil and gas sector. To that end, on May 12, 2016, the EPA finalized the first-ever national rule to directly limit methane emissions from oil and gas operations. The final NSPS is expected to reduce 510,000 short tons of methane in 2025, or the equivalent of reducing 11 million metric tons of carbon dioxide. At natural gas well sites, the NSPS has mandated new requirements for detecting and repairing leaks, and requirements to limit emissions from certain specified equipment types.

Despite the strong push to reduce methane emissions, there has been recent changes in the political landscape that have resulted in stays of certain requirements under the EPA rule. For instance, on Nov. 1, 2017, the EPA announced that it is issuing two notices of data availability related to the agency's proposed stays of certain requirements in the 2016 NSPS for the oil and natural gas industry. Nevertheless, the overall trends continue to be toward the significant reduction of methane emissions in the oil and gas industry.

One consideration for the reduction of methane emissions in the industry is in the capture and catalyzation of wellhead emissions. U.S. Patent Publication No. 2017/0120191 A1, for a Wellhead Emission Control System, published May 4, 2017 to Nurkowski et al. et al., which is herein incorporated by reference, describes a system for introducing vented methane to a catalytic heater assembly resident in a housing unit to break down the methane in the presence of oxygen into a less harmful carbon dioxide and water vapor. Though carbon dioxide is also a greenhouse gas, its short-term effects are less harmful to the atmosphere than that of methane.

In addition to wellhead emissions described above, there are other types of natural gas systems besides wells that may vent methane or other gases into the atmosphere. Accordingly, there may be a need for a system that can process gas both at a wellhead and in other applications where methane gas is vented to the atmosphere.

In view of the above, it may be desirable to develop an emission reduction system that can more efficiently process larger volumes of methane gas. Additionally, it may be desirable to develop an emission reduction system that can capture excess heat generated by the catalytic heaters for other purposes.

At least an exemplary embodiment of a system for emission reduction may include a housing defining a housing interior, a gas inlet configured to receive gas, a first emission reduction module comprising a first catalytic heater, and internal tubing disposed in the housing interior and configured to transport and control the gas to the first catalytic heater of the first emission reduction module.

At least an exemplary embodiment of a system for emission reduction may include a first emission reduction module comprising a first catalytic heater, a second emission reduction module comprising a second catalytic heater, and a thermal energy conversion module provided between the first catalytic heater and the second catalytic heater. The first catalytic heater may be inclined relative to a vertical direction at a first predetermined inclination angle. The second catalytic heater is inclined relative to a vertical direction at a second predetermined inclination angle.

At least an exemplary embodiment of a method of reducing emissions may include providing a first catalytic heater, providing a thermal energy conversion module proximate to the first catalytic heater, transferring heat energy from the first catalytic heater to the thermal energy conversion module, using the heat energy transferred to the thermal energy conversion module to perform a task.

BRIEF DESCRIPTION OF THE SEVERAL VIEWS OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
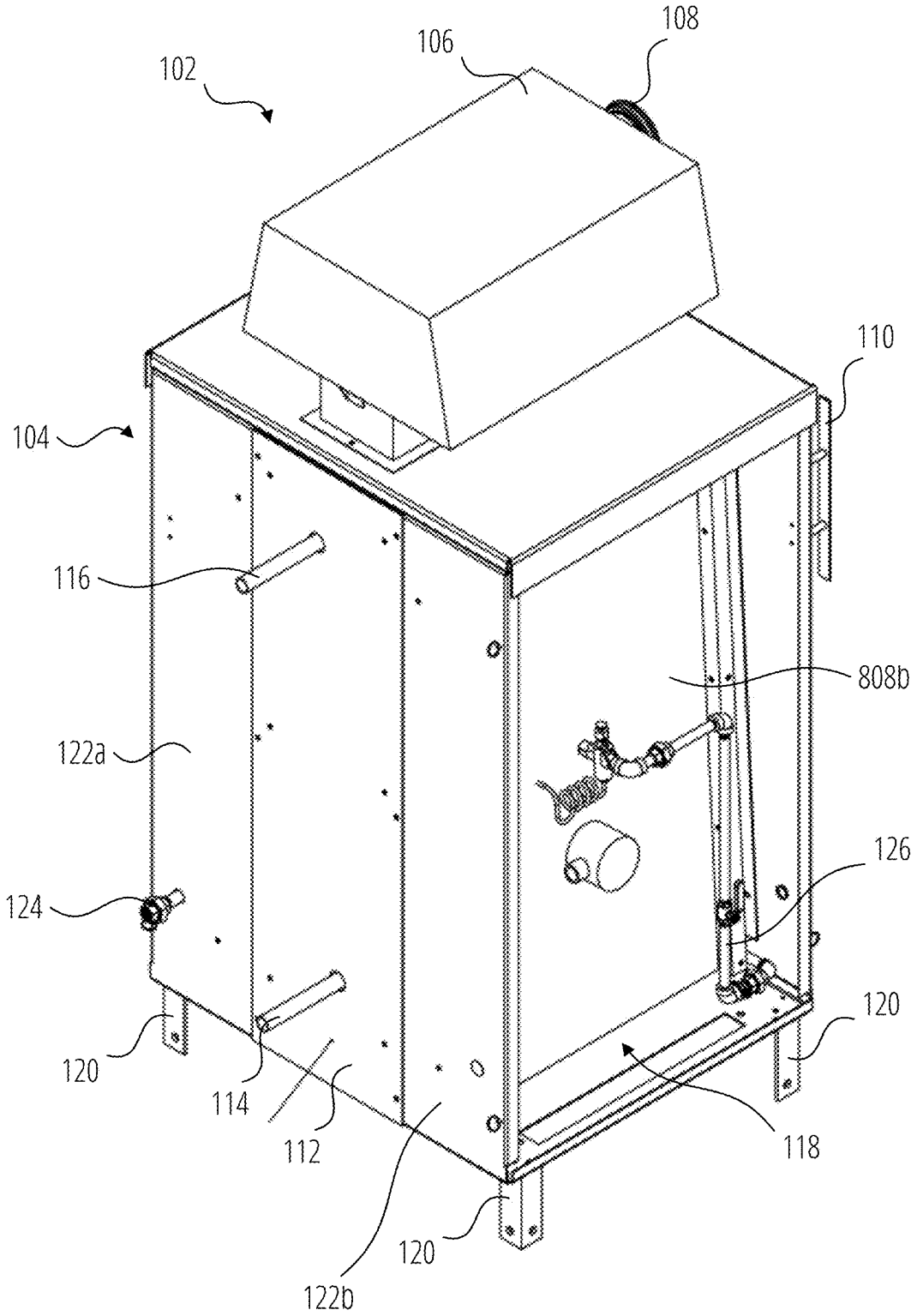
FIG. 1 is a perspective view of an emission reduction system according to an exemplary embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to aid in understanding the features of the exemplary embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various exemplary embodiments. Each example is provided by way of explanation and is not meant as a limitation and does not constitute a definition of all possible embodiments. It is understood that reference to a particular "exemplary embodiment" of, e.g., a structure, assembly, component, configuration, method, etc. includes exemplary embodiments of, e.g., the associated features, subcomponents, method steps, etc. forming a part of the "exemplary embodiment."

FIG. 1 through FIG. 10 illustrate one possible embodiment of a system for an emission reduction system 102. The emission reduction system 102 may include a housing 104 that defines a housing interior 118. The housing 104 may be supported by one or more legs 120. The housing 104 may further include power cord brackets 110 provided on an exterior of the housing 104 for storing power cords.

An exhaust module 106 may be provided on a top surface of the housing 104 and be configured to both release exhaust gas and protect the housing interior 118 from precipitation, dirt, and/or debris. The exhaust module 106 may include an exhaust thermometer 108 configured to measure a temperature of the exhaust gas. Additionally, the emission reduction system 102 may include further instrumentation and/or displays, such as a gas flow meter (not shown) coupled to an intake of the housing 104 and configured to display the amount of methane or other gases that have been processed. This information may be useful for documenting mitigation for carbon credit markets or for monitoring performance of the device. The displays on the emission reduction system 102 may be configured for real-time flow monitoring and/or batch data related to the amount of gas processed in a particular time period (e.g., per day, per week, per month, etc.). The emission reduction system 102 may further include communications modules configured to transmit data and/or receive instructions via wireless or wired communication.

The emission reduction system 102 may include a gas inlet 124 configured to receive gas such as methane from a wellhead or other sources that may vent methane to the atmosphere. The gas inlet 124 may be connected to internal tubing 126 provided within the housing interior 118. The term internal tubing 126 may be used to collectively refer to tubing, pipes, valves, connectors or other similar hardware used for transporting and controlling the gas.

The emission reduction system 102 may further include a first emission reduction module 122*a* and a second emission reduction module 122*b*, the details of which are described below. The emission reduction system 102 may also include thermal energy conversion module such as a heat exchanger cartridge 112 having a heat exchanger inlet 114 and a heat exchanger outlet 116. In alternative embodiments, the thermal energy conversion module may be a thermo-electric generator or an air-to-air heat exchanger.

Figure 2:
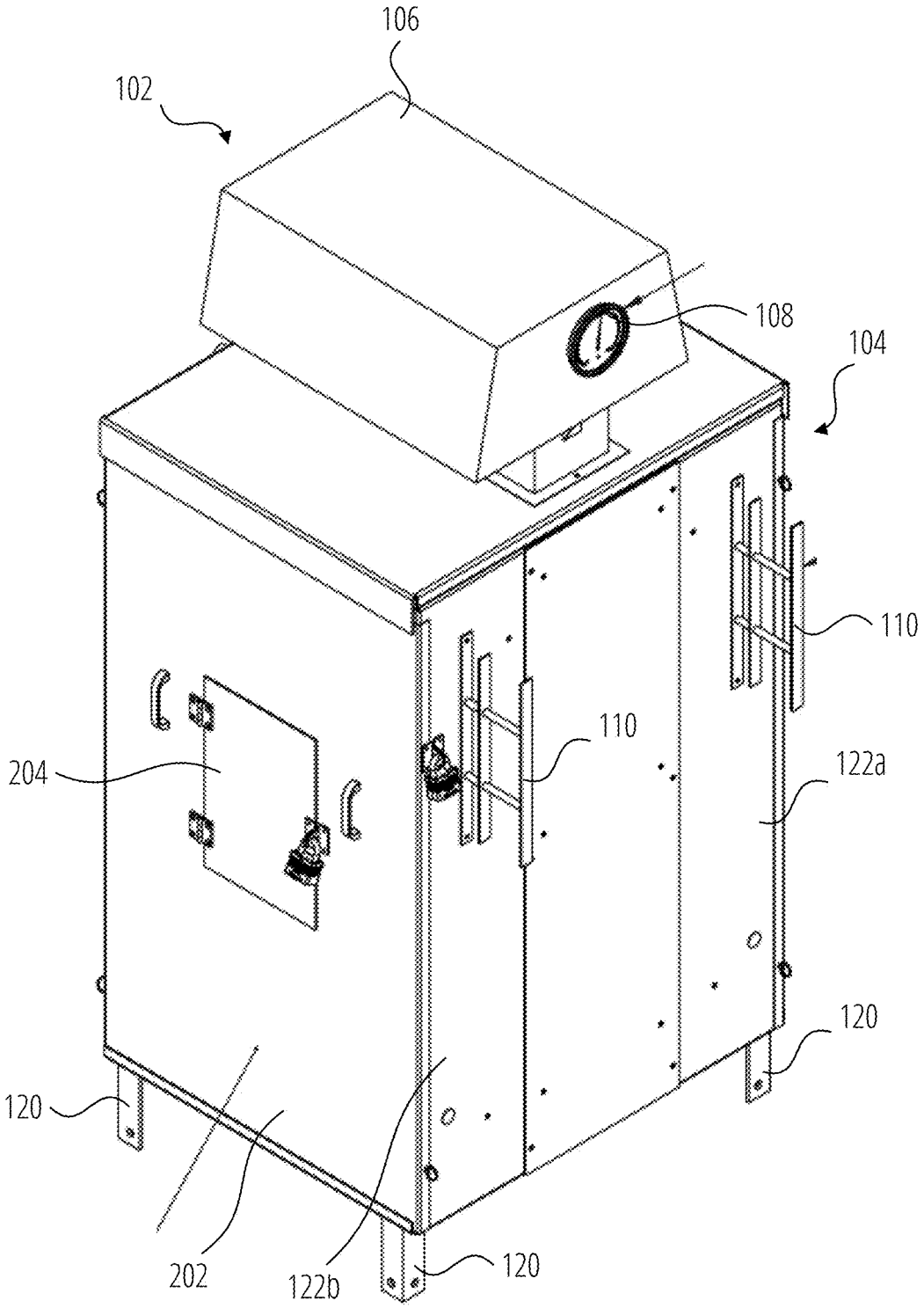
FIG. 2 is a perspective view of an emission reduction system according to an exemplary embodiment.
Figure 3:
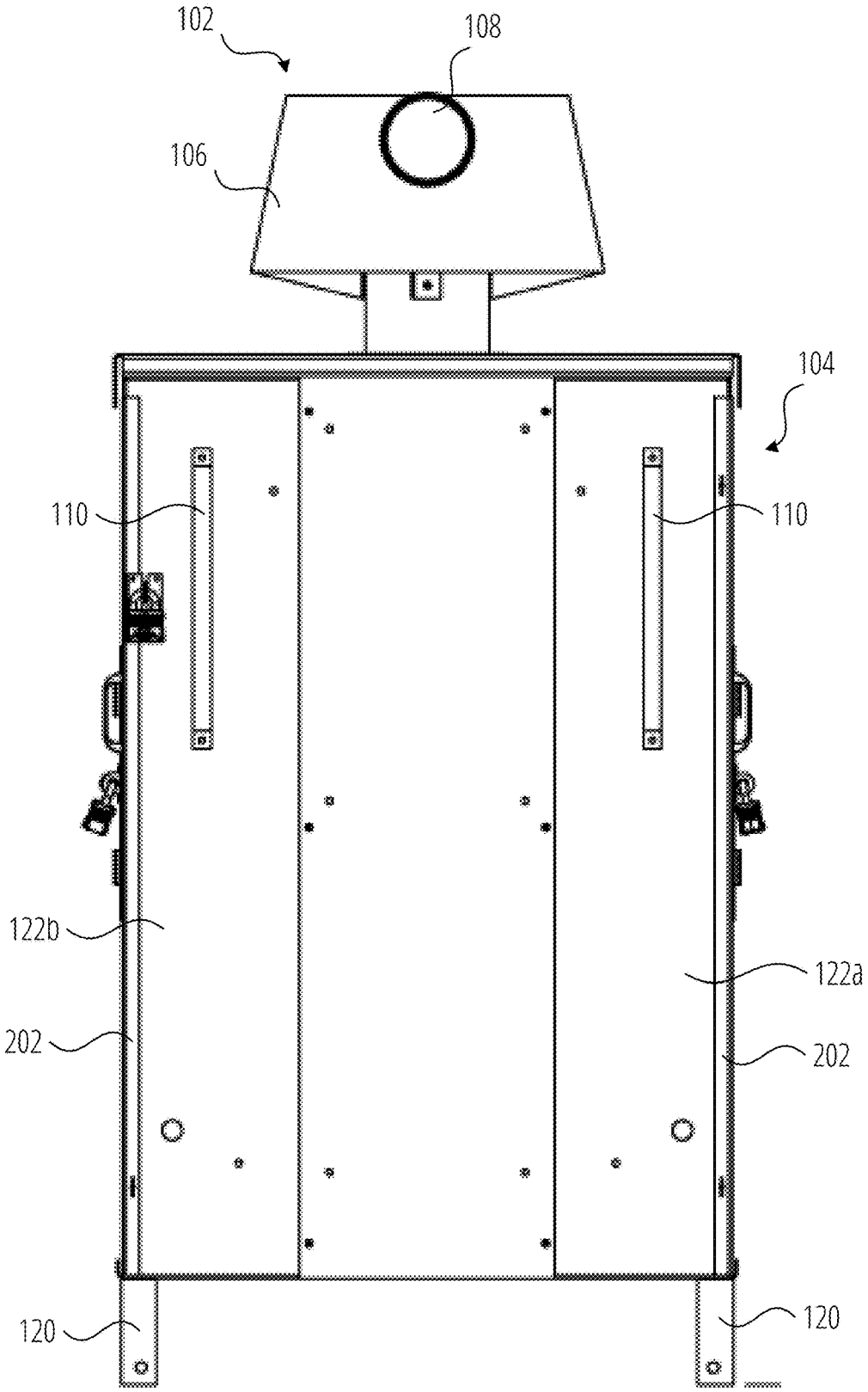
FIG. 3 is a front view of an emission reduction system according to an exemplary embodiment.

As seen in FIG. 2, the emission reduction system 102 may further include removable panels 202 on the side of the housing 104. Access doors 204 may be provided in the removable panels 202 or other panels of the housing 104 to allow access to internal components.

Figure 7:
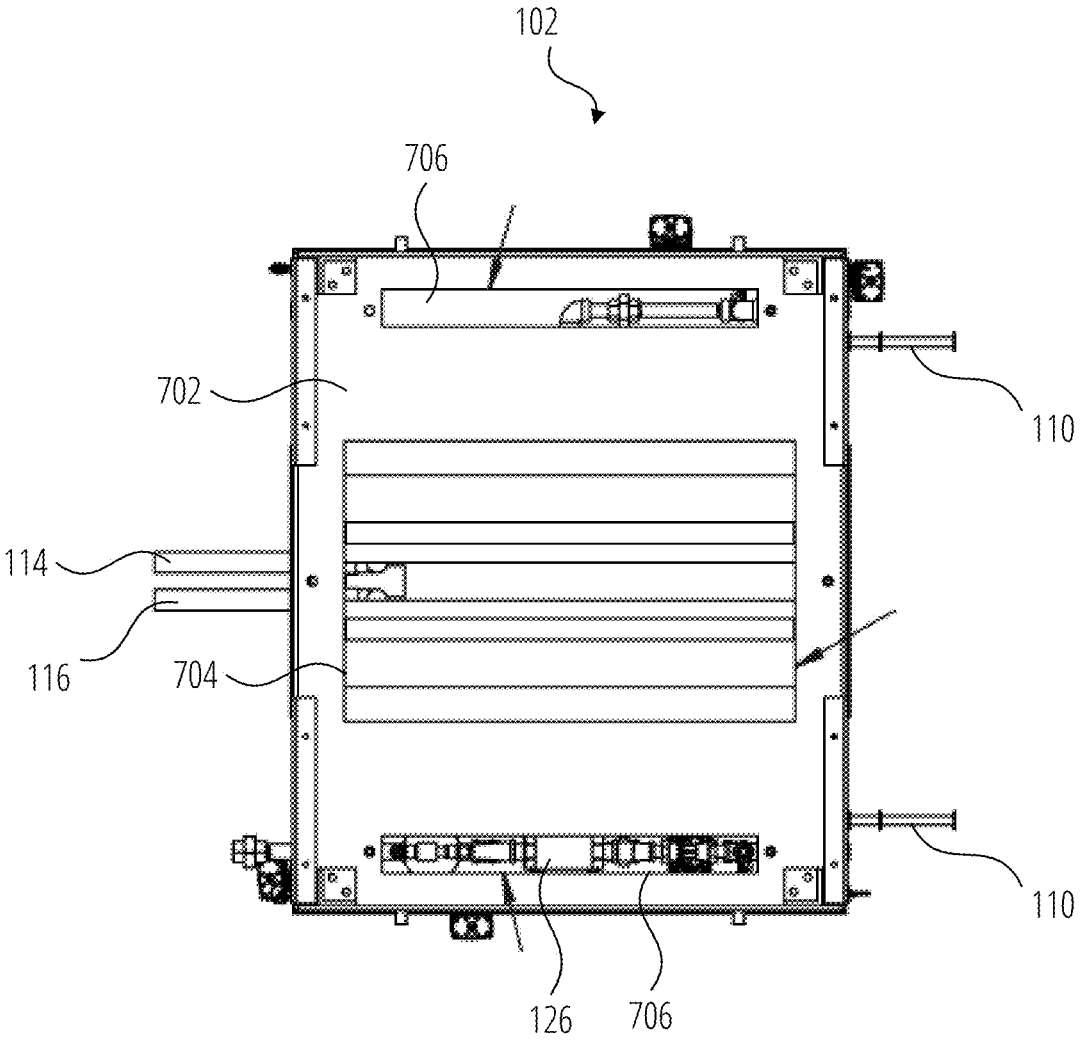
FIG. 7 is a bottom view of an emission reduction system according to an exemplary embodiment.
Figure 8:
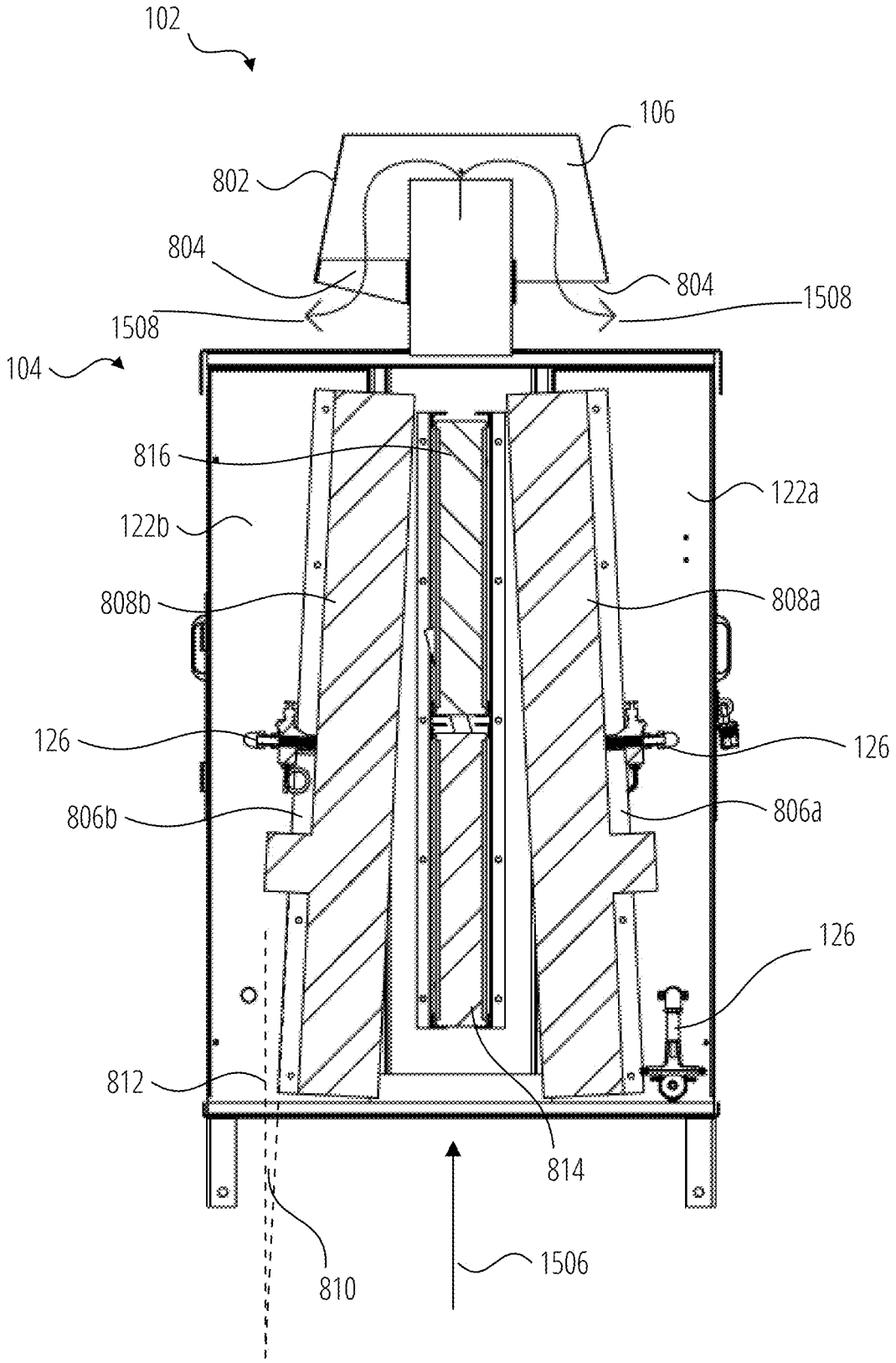
FIG. 8 is a cross-section view of the emission reduction system of FIG. 4 along line A-A.
Figure 9:
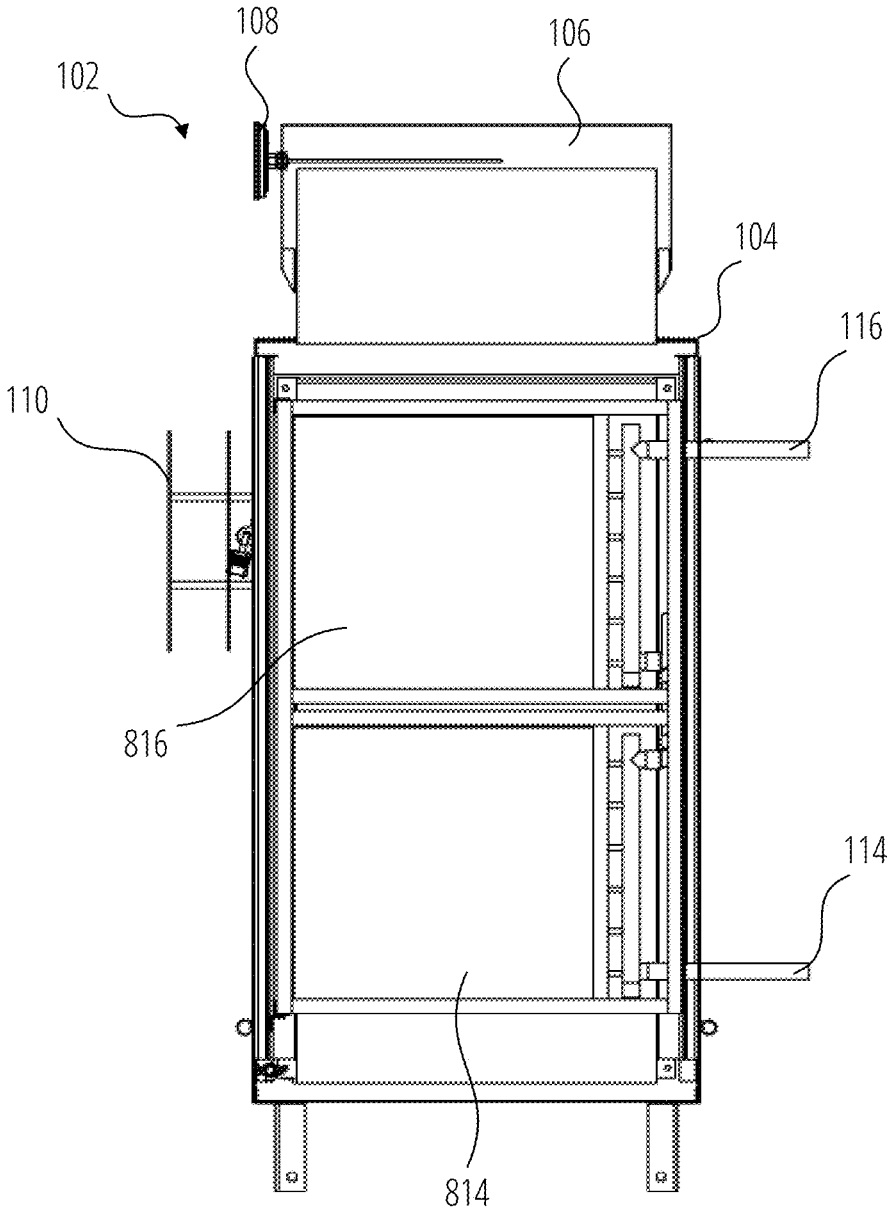
FIG. 9 is a cross-section view of the emission reduction system of FIG. 5 along line B-B.
Figure 10:
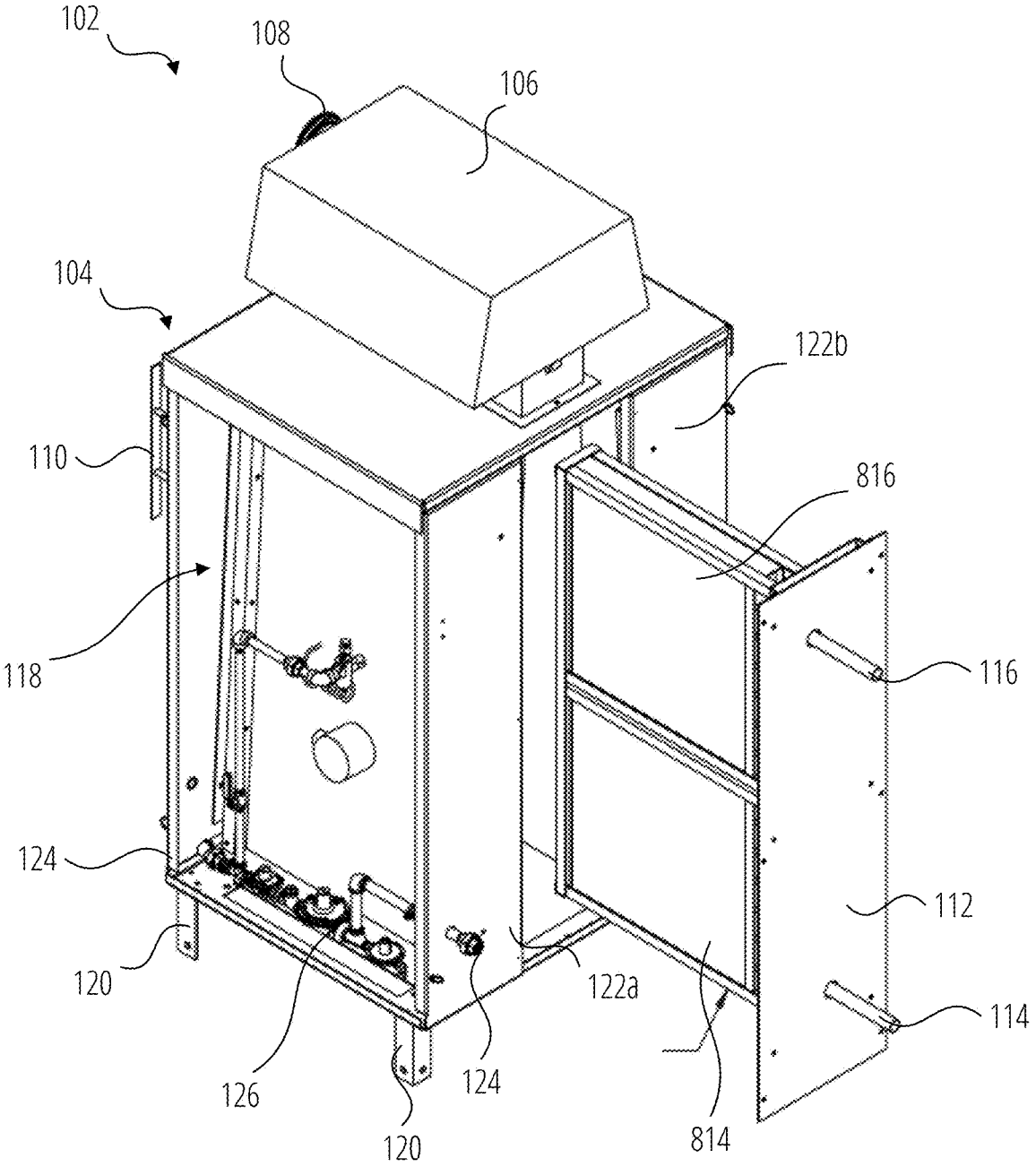
FIG. 10 is a perspective view of an emission reduction system according to an exemplary embodiment.
Figure 11A:
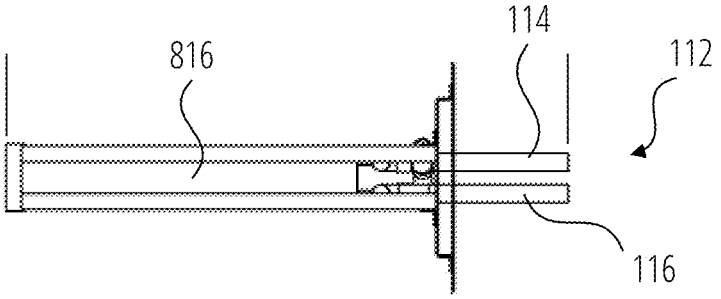
FIG. 11A is a top view of a thermal energy conversion module according to an exemplary embodiment.
Figure 11B:
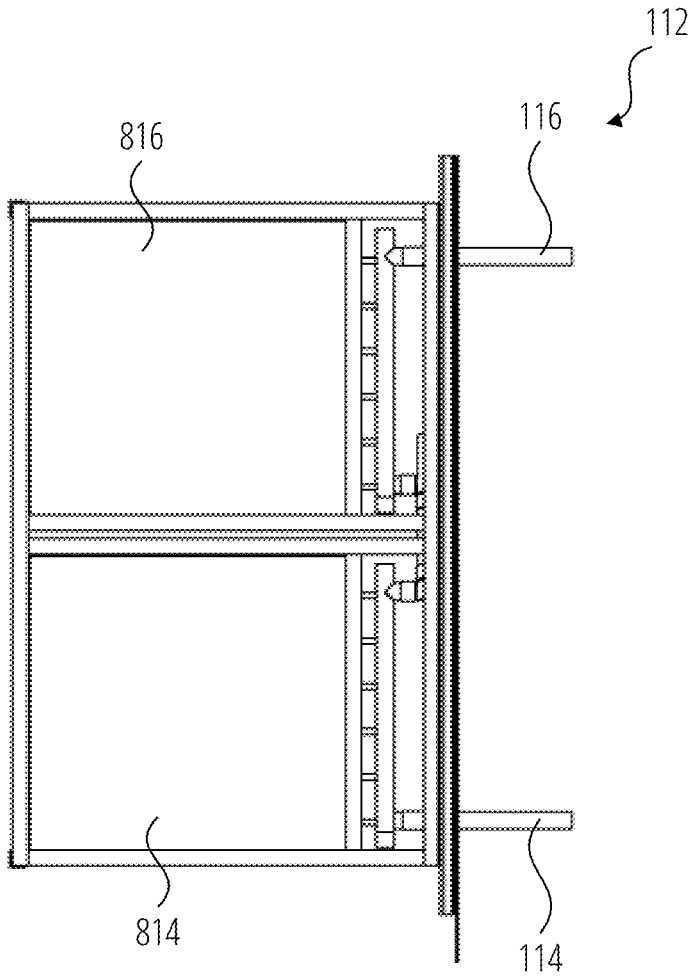
FIG. 11B is a side view of a thermal energy conversion module according to an exemplary embodiment.
Figure 11C:
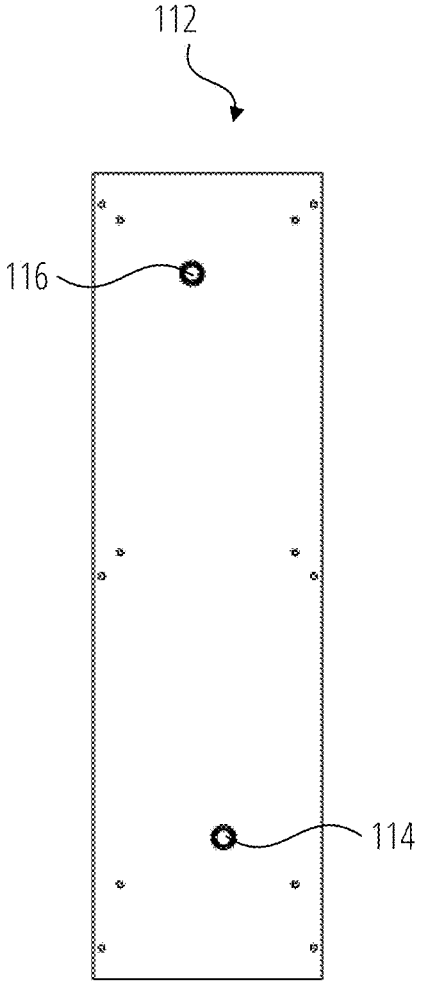
FIG. 11C is a rear view of a thermal energy conversion module according to an exemplary embodiment.
Figure 12:
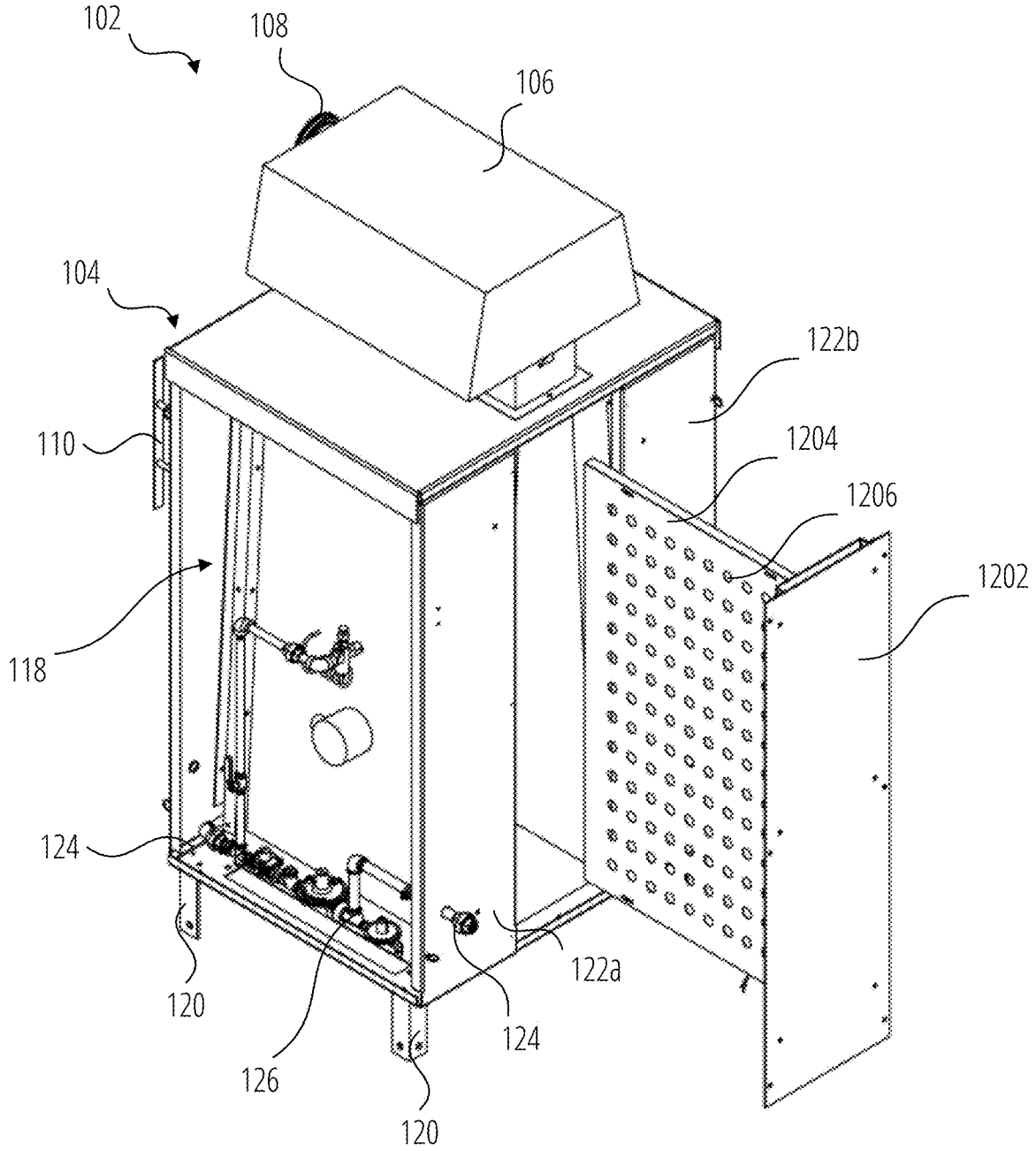
FIG. 12 is a perspective view of an emission reduction system according to an exemplary embodiment.
Figure 13A:
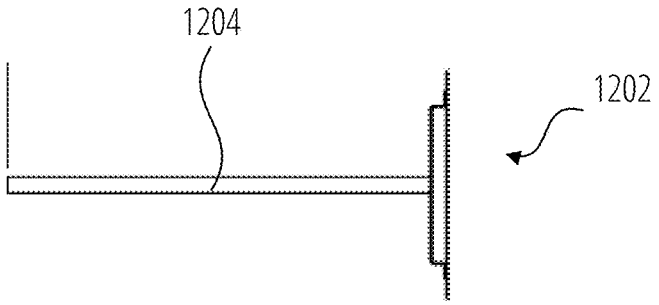
FIG. 13A is a top view of a target plate cartridge according to an exemplary embodiment.
Figure 13B:
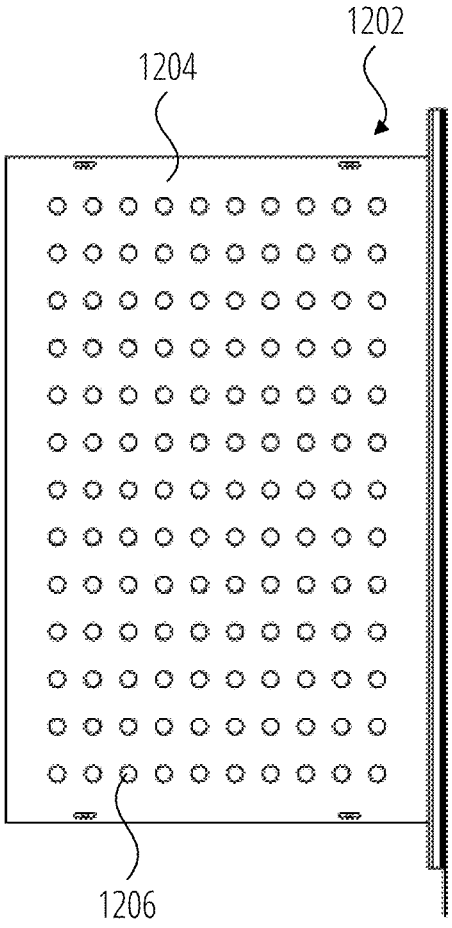
FIG. 13B is a side view of a target plate cartridge according to an exemplary embodiment.
Figure 13C:
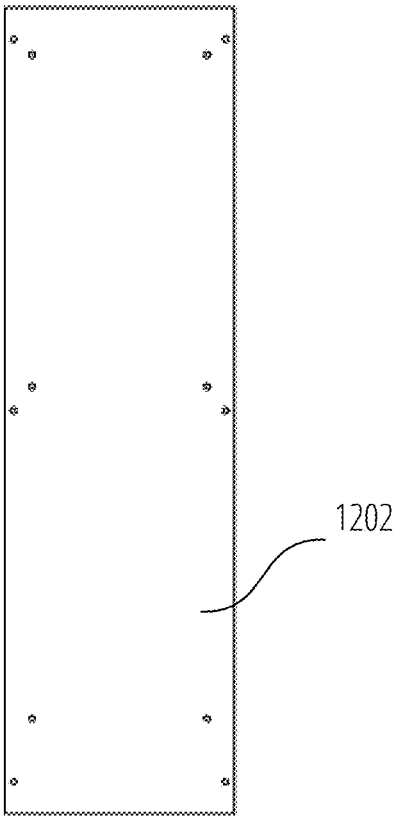
FIG. 13C is a rear view of a target plate cartridge according to an exemplary embodiment.
Figure 15:
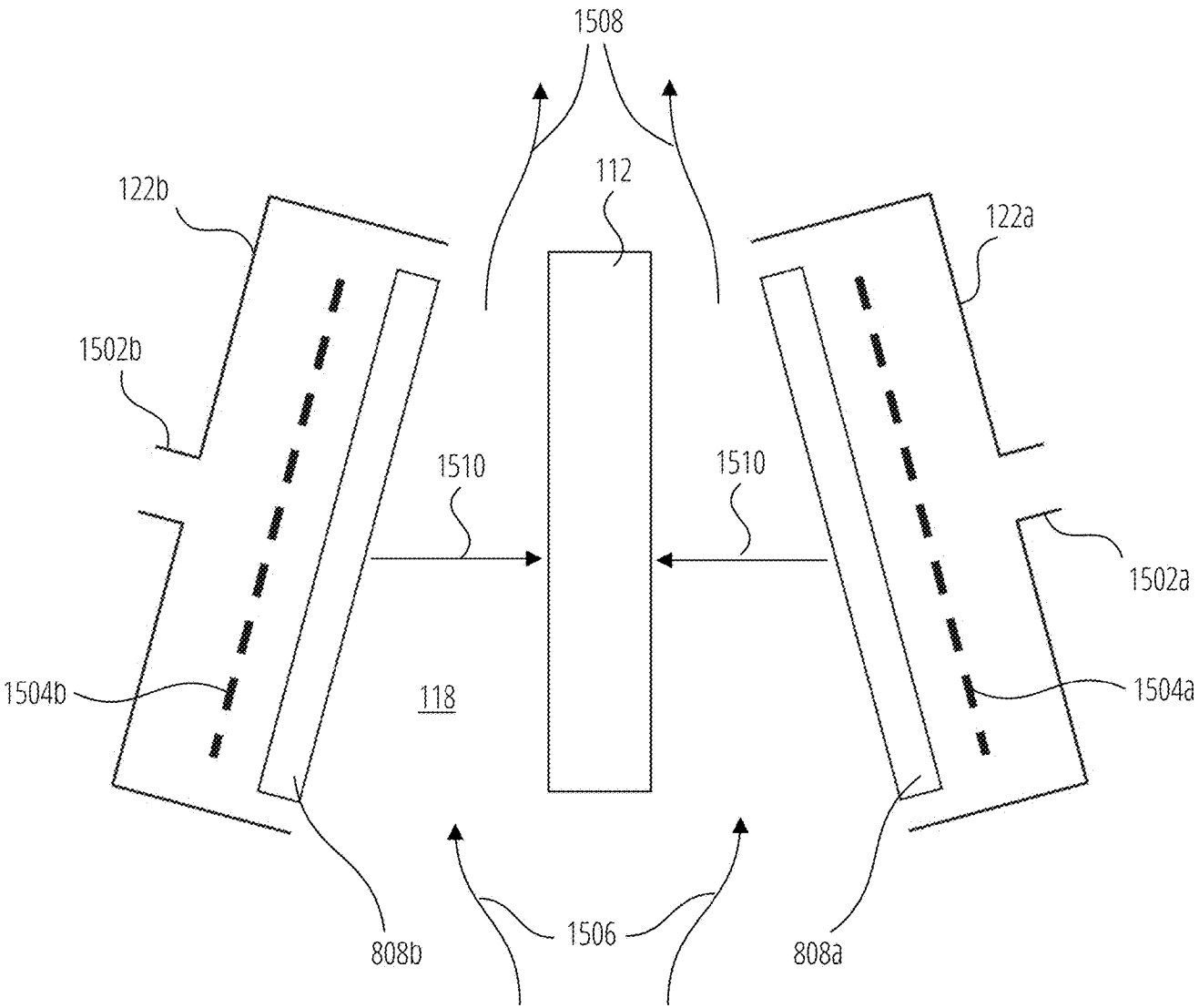
FIG. 15 is a schematic diagram illustrating operation of a first emission reduction module and a second emission reduction module according to an exemplary embodiment.

As seen in FIG. 7, the housing 104 may include an air inlet vent 704 provided on a bottom panel 702 of the housing 104. The air inlet vent 704 is configured to allow fresh air 1506 to enter the housing interior 118 (see also FIG. 15). The housing 104 may further include one or more door vents 706 provided on the bottom panel 702. As seen in FIG. 7, FIG. 8, and FIG. 15, fresh air 1506 may be drawn in through the air inlet vent 704 and or the door vents 706 via convection as exhaust gas 1508 exits emission reduction system 102 via the exhaust module 106.

Figure 4:
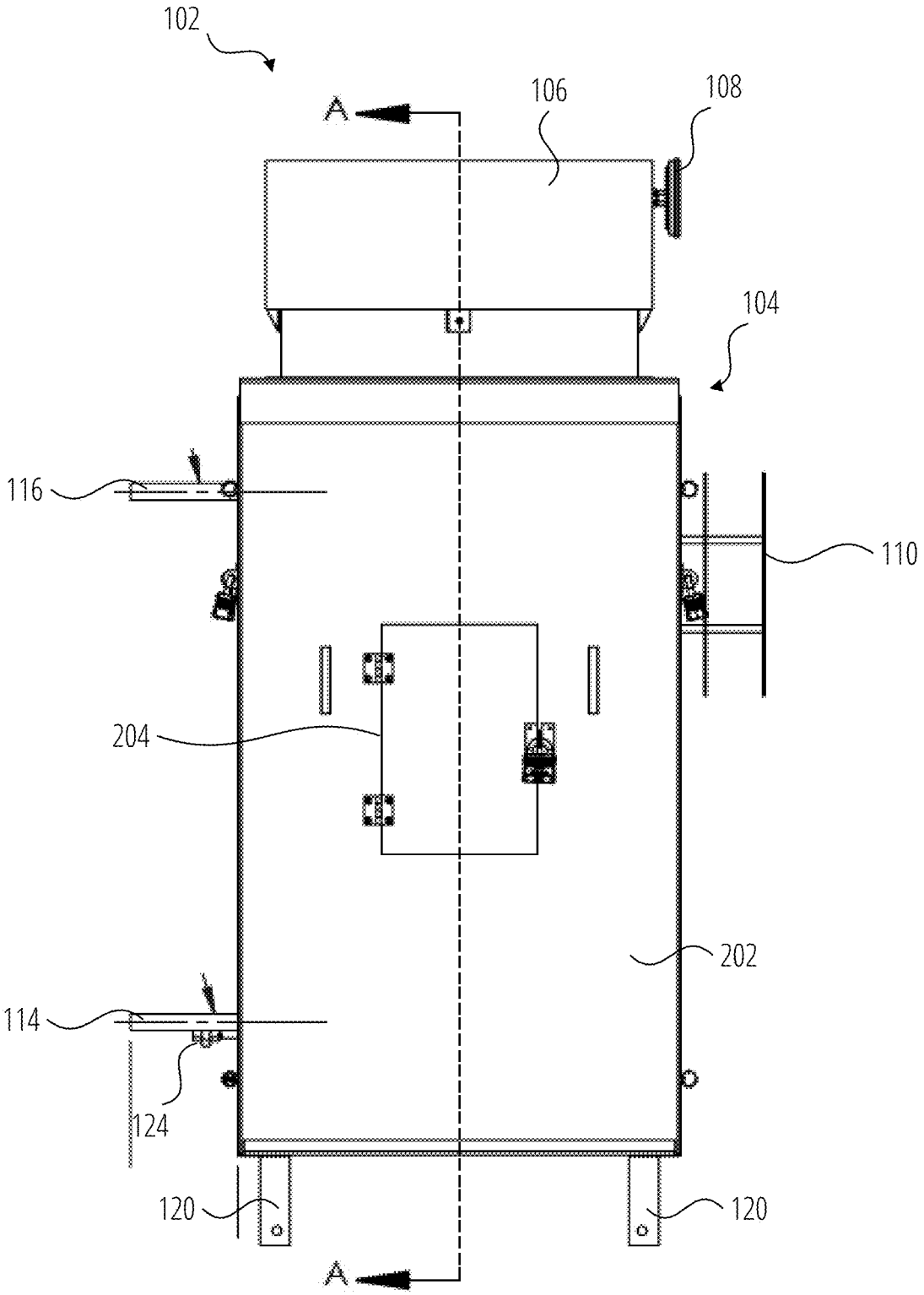
FIG. 4 is a left side view of an emission reduction system according to an exemplary embodiment.
Figure 5:
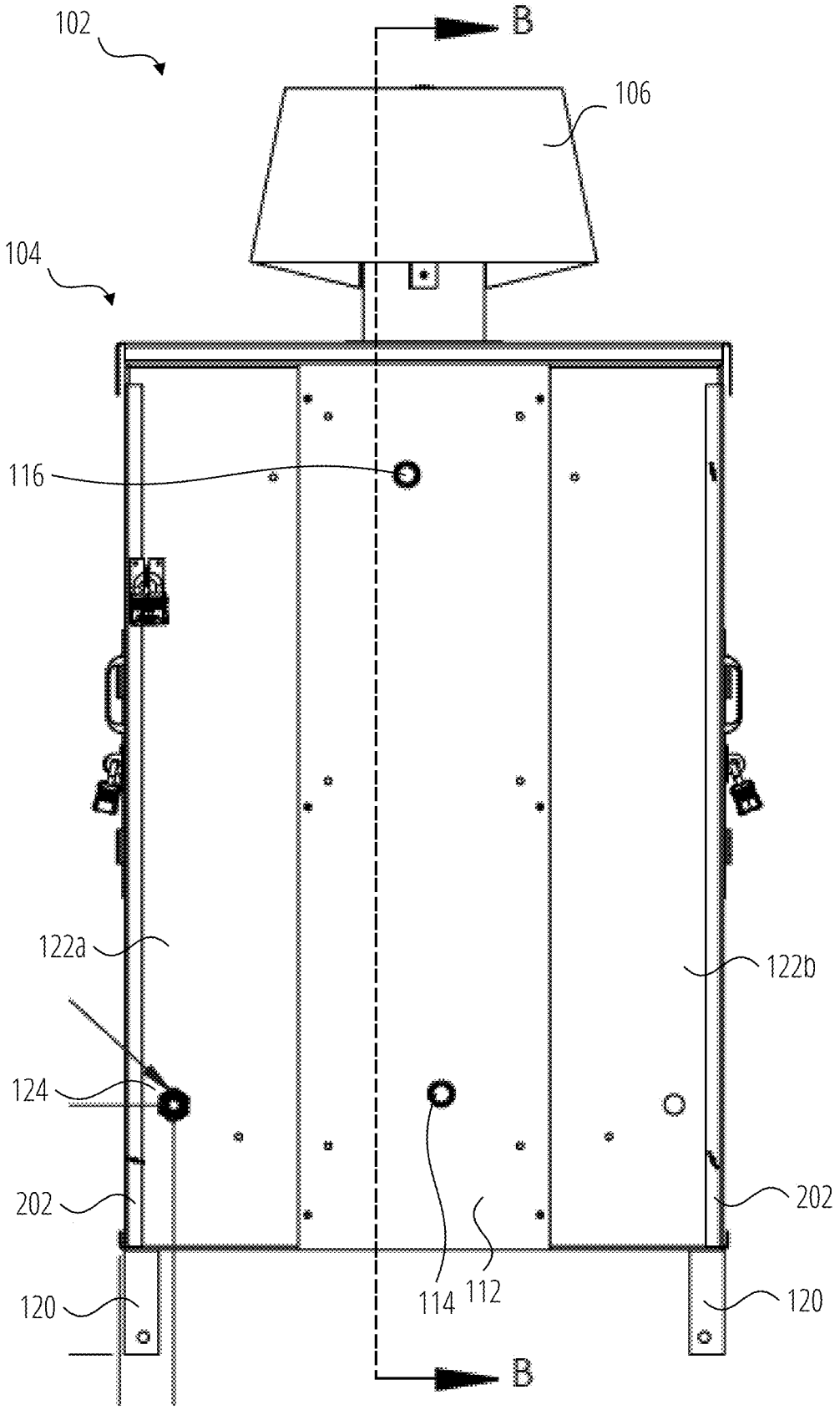
FIG. 5 is a rear view of an emission reduction system according to an exemplary embodiment.
Figure 6:
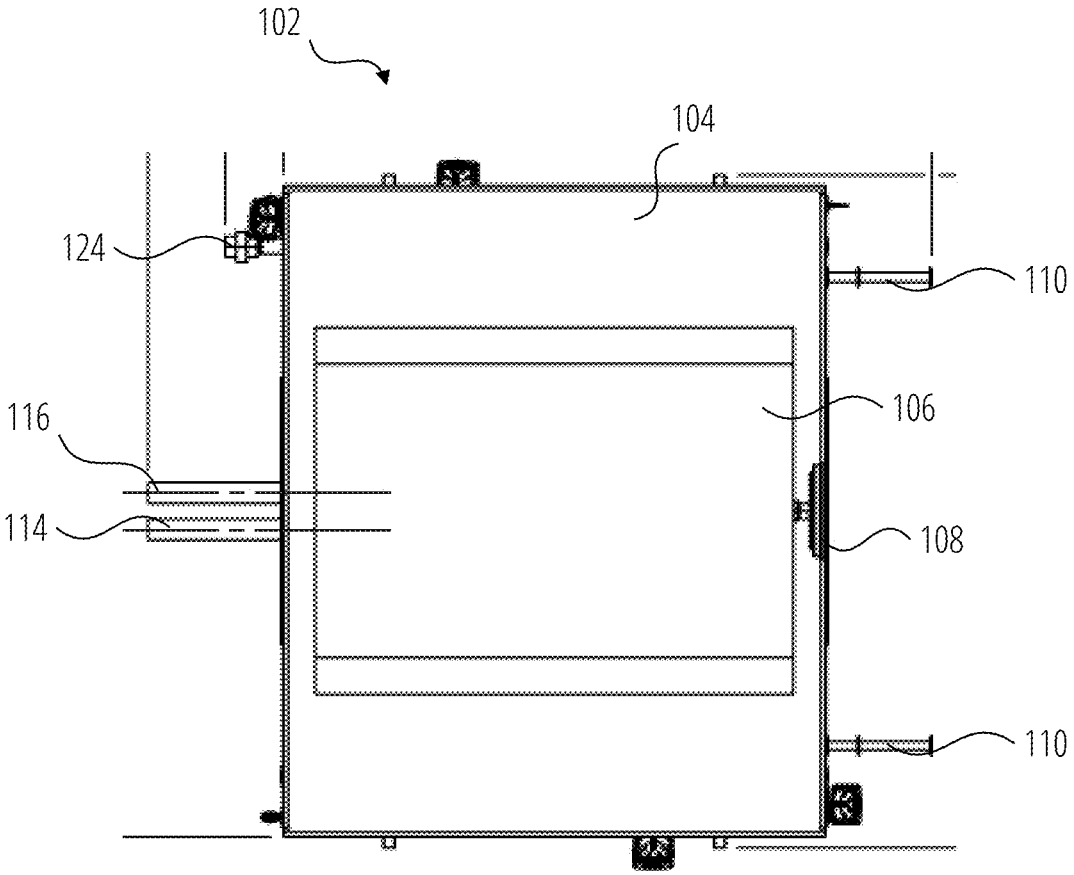
FIG. 6 is a top view of an emission reduction system according to an exemplary embodiment.

As further seen in FIG. 8, the exhaust module 106 is shown as a cross-section view cut through line A-A from FIG. 4. The exhaust module 106 may include an exhaust cover 802 and one or more exhaust outlets 804. The exhaust gas 1508 may exit the emission reduction system 102 via the exhaust outlets 804.

As further seen in FIG. 8, the first emission reduction module 122*a* may include a first mounting bracket 806*a* and a first catalytic heater 808*a* mounted on the first mounting bracket 806*a*. Similarly, the second emission reduction module 122*b* may include a second mounting bracket 806*b* and a second catalytic heater 808*b* mounted on the second mounting bracket 806*b*. The internal tubing 126 may be configured to supply vented gas to the first catalytic heater 808*a* and the 808*b* for treatment and methane abatement. After passing through the first catalytic heater 808*a* and/or the second catalytic heater 808*b*, the treated gas exits towards the center of the housing 104 and will then be drawn up through the exhaust module 106 through convection as exhaust gas 1508. For example, the exhaust gas 1508 is heated by the 808*a* and/or the 808*b*, which causes the exhaust gas 1508 to rise and exit through the exhaust module 106. The exit of the exhaust gas 1508 through the exhaust module 106 creates a localized lower pressure within the emission reduction system 102, which causes fresh air 1506 to be drawn into the emission reduction system 102 through the air inlet vent 704 and/or the door vent 706 to equalize the pressure. Additional details of the structure and function of a catalytic heater such as the first catalytic heater 808*a* and the second catalytic heater 808*b* can be found in U.S. Pat. No. 10,577,883 issued to Etter Engineering Company, Inc., which is hereby incorporated by reference in its entirety.

FIG. 15 is a schematic diagram illustrating the operation of the first emission reduction module 122*a* and the second emission reduction module 122*b* according to an exemplary embodiment. The first emission reduction module 122*a* may include a first gas connection 1502*a* and the second emission reduction module 122*b* may include a second gas connection 1502*b*. The first gas connection 1502*a* and the second gas connection 1502*b* may supply methane gas or other gas to the first emission reduction module 122*a* and the second emission reduction module 122*b* respectively. In an exemplary embodiment, the first gas connection 1502*a* and the second gas connection 1502*b* may supply gas via the internal tubing 126 described above. The first emission reduction module 122*a* may further include a first perforated plate 1504*a* and the first catalytic heater 808*a*. The second emission reduction module 122*b* may include a second perforated plate 1504*b* and the second catalytic heater 808*b*. Further details of the first perforated plate 1504*a* and the second perforated plate 1504*b* are described below.

While the discussion below will refer to the first emission reduction module 122*a* and its components, it will be understood that the description will apply equally to the second emission reduction module 122*b* and its components. Vented gas may be brought from the source through the internal tubing 126 to the first gas connection 1502*a*. The vented gas may flow into the first emission reduction module 122*a* where it is evenly disbursed across the first catalytic heater 808*a*, which may include, for instance, a platinum based catalytic pad. Through an exothermic chemical reaction, the vented gas is oxidized with the fresh air 1506 present at the face of the first catalytic heater 808*a* resulting in the release of exhaust gas 1508 while outputting heat as infrared energy. In other words, the platinum catalyst causes the oxidation of methane into carbon dioxide and water vapor at lower temperatures. For example, the presence of the platinum catalyst may facilitate a flameless, non-burning oxidation of methane gas in a temperature range of 400-900 degrees Fahrenheit. The carbon dioxide and water vapor, indicated as exhaust gas 1508 in FIG. 15, may vent through the exhaust module 106 via convection. The heat energy 1510 generated by the exothermic catalytic reaction may be radiated to the heat exchanger cartridge 112, where it may be used to perform other tasks, such as heating surfaces to melt snow and ice, providing heat to other equipment, or other suitable uses.

The first catalytic heater 808*a* and the second catalytic heater 808*b* may be arranged to face each other in the housing interior 118. In an exemplary embodiment, the first catalytic heater 808*a* and the second catalytic heater 808*b* may be mounted substantially vertically. In another exemplary embodiment, the first catalytic heater 808*a* and the second catalytic heater 808*b* may be inclined with respect to a vertical direction 812 at a predetermined inclination angle 810. The first catalytic heater 808*a* and the second catalytic heater 808*b* may be inclined at the same inclination angle 810, or the first catalytic heater 808*a* and the second catalytic heater 808*b* may have different inclination angles 810. In an exemplary embodiment, the inclination angle 810 may be greater than 0 degrees and less than or equal to 45 degrees. In a further exemplary embodiment, the inclination angle 810 may be in a range from 10 degrees to 20 degrees. In a further exemplary embodiment, the inclination angle 810 may be 15 degrees. It will also be understood that in an exemplary embodiment, the inclination angle may be equal to 0 degrees, i.e., the first catalytic heater 808*a* and the second catalytic heater 808*b* may be substantially vertical. The inclination angle 810 may be adjusted to improve efficiency of the first catalytic heater 808*a* and the second catalytic heater 808*b*. Additionally, the inclination angle 810 may also help to protect the first catalytic heater 808*a* and the second catalytic heater 808*b* from any stray water or debris that may enter the housing interior 118. Additionally, a drip lip (not shown) may be provided at a top side of the first catalytic heater 808*a* and the 808*b* so that any water that does happen to get into the housing interior 118 will drip down the center of the housing interior 118 without contacting the first catalytic heater 808*a* or the second catalytic heater 808*b*.

The embodiment described above includes two catalytic heaters, but it will be understood that the disclosure is not limited to this embodiment. For example, a housing 104 may be provided having a single first mounting bracket 806*a* and a single first catalytic heater 808*a*. In this embodiment, a smaller housing 104 may be used to provide additional flexibility in placement, and/or the side of the housing 104 where the second mounting bracket 806*b* was mounted may have a solid wall without a cut-out or be provided with a filler panel.

As noted above, the emission reduction system 102 may further include a heat exchanger cartridge 112. FIG. 10, FIG. 11A, FIG. 11B, and FIG. 11C show that the heat exchanger cartridge 112 may include a heat exchanger inlet 114, a first heat exchanger compartment 814, a second heat exchanger compartment 816, and a heat exchanger outlet 116. The heat exchanger inlet 114 may supply a temperature control fluid to the first heat exchanger compartment 814 and the second heat exchanger compartment 816. The heat exchanger inlet 114 may be connected to a pumping system and/or reservoir outside of the emission reduction system 102. In the first heat exchanger compartment 814 and the second heat exchanger compartment 816, the temperature control fluid may absorb excess heat generated by the first catalytic heater 808*a* and the second catalytic heater 808*b*. In other words, heat energy is transferred from the first catalytic heater 808*a* and/or the second catalytic heater 808*b* to the first heat exchanger compartment 814 and/or the second heat exchanger compartment 816. Then heated temperature control fluid can exit the heat exchanger cartridge 112 via the heat exchanger outlet 116. The heated temperature control fluid leaving the heat exchanger outlet 116 can be used to supply energy for performing a task, such as heating surfaces to melt snow and ice, providing heat to other equipment, or other suitable uses. Ultimately, the temperature control fluid can be recirculated back through the system after the task has been performed and the temperature control fluid returns to its original temperature.

In an exemplary embodiment, the temperature control fluid may be glycol. In an alternative embodiment, the temperature control fluid may be a mixture of glycol and water. In an alternative embodiment, the temperature control fluid may be water if ambient temperature allows. It will be understood that the temperature control fluid is not limited to these embodiments, and that any suitable heat transfer fluid may be used in the heat exchanger cartridge 112.

While the Figures show a first heat exchanger compartment 814 and a second heat exchanger compartment 816, it will be understood that the disclosure is not limited to this configuration. For example, there may be a single heat exchanger compartment or more than two heat exchanger compartments. Additionally, in an embodiment with multiple heat exchanger compartments, the heat exchanger compartments may be arranged serially or in parallel.

As an alternative to the heat exchanger cartridge 112, the housing 104 may be equipped with other types of heat recovery devices provided between the first catalytic heater 808*a* and the second catalytic heater 808*b*. For example, the housing 104 may include a thermos-electric generator or an air-to-air heat exchanger. A thermoelectric generator may use the excess heat energy from the first catalytic heater 808*a* and the second catalytic heater 808*b* to generate electricity for powering other equipment or devices.

In some embodiments, a user may not wish to use a heat exchanger cartridge 112 in the emission reduction system 102. In these situations, the heat exchanger cartridge 112 may be replaced with a target plate cartridge 1202, as seen in FIG. 12, FIG. 13A, FIG. 13B, and FIG. 13C. The target plate cartridge 1202 may include a target plate 1204, and a plurality of target plate holes 1206 may be provided in the target plate 1204. The target plate cartridge 1202 helps to compartmentalize the heat for the first catalytic heater 808*a* and the second catalytic heater 808*b* while still facilitating air flow through the emission reduction system 102.

Figure 14:
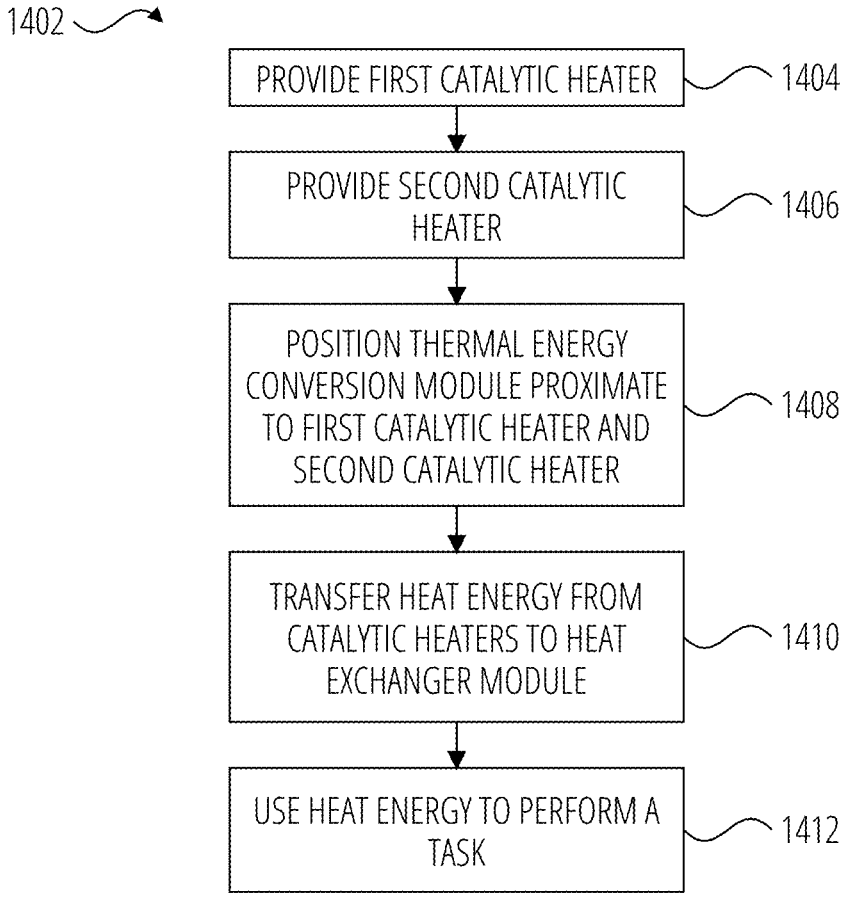
FIG. 14 is a flowchart illustrating a method of reducing emissions according to an exemplary embodiment.

FIG. 14 is a flowchart showing an exemplary embodiment of a method 1402 of reducing emissions. In block 1404, a first catalytic heater may be provided. The first catalytic heater of block 1404 may be similar to the first catalytic heater 808*a* described above. In block 1406, a second catalytic heater may be provided. The second catalytic heater of block 1406 may be similar to the second catalytic heater 808*b* described above.

In block 1408, a thermal energy conversion module may be positioned proximate to the first catalytic heater and the second catalytic heater. The thermal energy conversion module of block 1408 may be similar to the heat exchanger cartridge 112 described above. In an exemplary embodiment, the thermal energy conversion module may be positioned between the first catalytic heater and the second catalytic heater.

In block 1410, heat energy may be transferred from the first catalytic heater and/or the second catalytic heater to the thermal energy conversion module. In block 1412, the heat transferred to the thermal energy conversion module may be used to perform a task, such as heating surfaces to melt snow and ice, providing heat to other equipment, or other suitable uses. In an alternative embodiment, the thermal energy conversion module in method 1402 may be another type of heat recovery devices, such as a thermo-electric generator or an air to air heat exchanger as described above.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while considering that in some circumstances the modified term may sometimes not be appropriate, capable, or suitable. For example, in some circumstances an event or capacity can be expected, while in other circumstances the event or capacity cannot occur-this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A system for emission reduction, the system comprising:

a housing defining a housing interior; and a gas inlet configured to receive gas;

a first emission reduction module comprising a first catalytic heater; and internal tubing disposed in the housing interior and configured to transport and control the gas to the first catalytic heater of the first emission reduction module;

wherein the first catalytic heater is inclined relative to a vertical direction at a first predetermined inclination angle.

2. The system of claim 1, further comprising a second emission reduction module comprising a second catalytic heater;

wherein the internal tubing is configured to transport and control the gas to the second catalytic heater of the second emission reduction module.

3. The system of claim 1, wherein the second catalytic heater is inclined relative to a vertical direction at a second predetermined inclination angle.

4. The system of claim 3, wherein the first predetermined inclination angle is equal to the second predetermined inclination angle.

5. The system of claim 1, wherein the first predetermined inclination angle is greater than 0 degrees and less than or equal to 45 degrees.

6. The system of claim 1, wherein the first predetermined inclination angle is 15 degrees.

7. The system of claim 2, wherein the first catalytic heater and the second catalytic heater face each other within the housing.

8. The system of claim 2, wherein the first catalytic heater and the second catalytic heater are inclined toward each other.

9. The system of claim 2, further comprising a thermal energy conversion module provided within the housing in proximity to the first catalytic heater.

10. The system of claim 9, wherein the thermal energy conversion module is provided between the first catalytic heater and the second catalytic heater.

11. The system of claim 10, wherein:

the thermal energy conversion module is disposed at an approximate center of the housing; and the first catalytic heater and the second catalytic heater are symmetrically disposed about the thermal energy conversion module.

12. The system of claim 9, wherein the thermal energy conversion module is a glycol heat exchanger.

13. The system of claim 1, further comprising an air inlet vent provided on a bottom surface of the housing.

14. The system of claim 1, further comprising an exhaust module at a top surface of the housing.

15. A system for emission reduction, the system comprising:

a first emission reduction module comprising a first catalytic heater;

a second emission reduction module comprising a second catalytic heater; and a thermal energy conversion module provided between the first catalytic heater and the second catalytic heater;

wherein the first catalytic heater is inclined relative to a vertical direction at a first predetermined inclination angle; and the second catalytic heater is inclined relative to a vertical direction at a second predetermined inclination angle.

16. The system of claim 15, wherein the first predetermined inclination angle is equal to the second predetermined inclination angle.

17. The system of claim 16, wherein:

the first emission reduction module, the second emission reduction module, and the thermal energy conversion module are provided within a housing;

the thermal energy conversion module is disposed at an approximate center of the housing; and the first catalytic heater and the second catalytic heater are symmetrically disposed about the thermal energy conversion module.

18. A method of reducing emissions, the method comprising:

providing a system comprising:

a housing defining a housing interior;

a gas inlet configured to receive gas;

a first emission reduction module comprising a first catalytic heater;

internal tubing disposed in the housing interior and configured to transport and control the gas to the first catalytic heater of the first emission reduction module; and a thermal energy conversion module provided within the housing in proximity to the first catalytic heater;

wherein the first catalytic heater is inclined relative to a vertical direction at a first predetermined inclination angle;

transferring heat energy from the first catalytic heater to the thermal energy conversion module; and using the heat energy transferred to the thermal energy conversion module to perform a task.

19. The method of claim 18, further comprising:

providing a second catalytic heater such that the thermal energy conversion module is between the first catalytic heater and the second catalytic heater; and transferring heat energy from the second catalytic heater to the thermal energy conversion module.

* * * * *